United States Patent [19]

Töpfl et al.

[11] Patent Number: 4,906,413

[45] Date of Patent: Mar. 6, 1990

[54] DIQUATERNARY AMMONIUM SALTS AND THE USE THEREOF AS TEXTILE FINISHING AGENTS

[75] Inventors: Rosemarie Töpfl, Dornach; Heinz Abel; Jörg Binz, both of Reinach, all of Switzerland

[73] Assignee: Ciba-Geigy Corporation, Ardsley, N.Y.

[21] Appl. No.: 270,378

[22] Filed: Nov. 10, 1988

Related U.S. Application Data

[63] Continuation of Ser. No. 925,059, Oct. 30, 1986, abandoned.

[30] Foreign Application Priority Data

Nov. 8, 1985 [CH] Switzerland ..... 4801/85

[51] Int. Cl.[4] ..... B01F 17/18; C07C 93/04; C07C 103/54; D06M 13/46

[52] U.S. Cl. ..... 260/404.5; 8/606; 252/8.8; 427/394; 428/279

[58] Field of Search ..... 260/404.5 Q; 252/8.8; 8/606; 427/394; 428/279

[56] References Cited

U.S. PATENT DOCUMENTS

| | | | |
|---|---|---|---|
| 2,259,650 | 10/1941 | Maxwell | 260/404.5 Q |
| 2,583,772 | 1/1952 | Gunderson | 260/404.5 Q X |
| 2,891,835 | 6/1959 | Matter et al. | 8/55 |
| 3,074,815 | 1/1963 | Lee et al. | 260/404.5 Q X |
| 4,312,813 | 1/1982 | Lindemann | 260/404.5 Q |
| 4,721,512 | 1/1988 | Topfl et al. | 8/188 |
| 4,728,337 | 3/1988 | Abel et al. | 8/606 |

FOREIGN PATENT DOCUMENTS

| | | | |
|---|---|---|---|
| 0008761 | 3/1980 | European Pat. Off. | 260/404.5 Q |
| 1092878 | 7/1957 | Fed. Rep. of Germany | 260/404.5 Q |
| 3329444 | 3/1985 | Fed. Rep. of Germany | 260/404.5 Q |

*Primary Examiner*—Floyd D. Higel

*Attorney, Agent, or Firm*—Wenderoth, Lind & Ponack

[57] ABSTRACT

Diquaternary ammonium salts of the formula

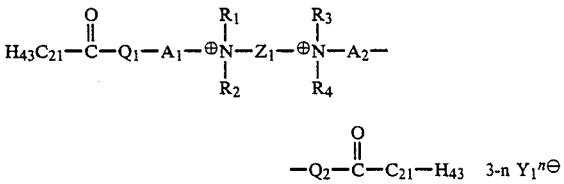

wherein $A_1$ and $A_2$ are each independently of the other $C_2$–$C_5$alkylene, $Q_1$ and $Q_2$ are each independently of the other —NH— or —O—, $R_1$, $R_2$, $R_3$ and $R_4$ are each independently alkyl, hydroxyalkyl or alkoxyalkyl, each containing 1 to 4 carbon atoms in the alkyl moiety, $Y_1^{1\ominus}$ is the anion of a strong acid, $Z_1$ is $C_3$–$C_{24}$alkylene which is substituted by hydroxy and may be interrupted by oxygen atoms and n is 1 or 2.

are suitable for use as textile finishing agents.

3 Claims, No Drawings

DIQUATERNARY AMMONIUM SALTS AND THE USE THEREOF AS TEXTILE FINISHING AGENTS

This application is a continuation of now abandoned application Ser. No. 925,059, filed Oct. 30, 1986.

The present invention relates to diquaternary ammonium salts, to a process for their preparation and to the use thereof as textile finishing agents. The diquaternary ammonium salts of this invention are prepared e.g. from dialkylaminoalkylbehenic acid amides and aliphatic epoxy compounds and therefore contain between the two quaternary nitrogen atoms aliphatic bridge members which are always substituted by at least one hydroxyl group.

DE-B-1 092 878 discloses diquaternary ammonium salts which are prepared from dialkylaminoalkyl fatty acid amides and an epoxy compound, with the starting fatty acids containing at most 18 carbon atoms. The known diquaternary ammonium salts are employed as dyeing auxiliaries, in particular as levelling agents for dyeings on polyacrylonitrile fibres.

US-A-4 312 813 also discloses diquaternary ammonium salts which are prepared e.g. from dialkylaminoalkylbehenic acid amides and aliphatic dihalogen compounds, e.g. $\beta,\beta'$-dibromodiethyl ether, and therefore contain between the two quaternary nitrogen atoms aliphatic bridge members which are free from hydroxyl substituents. These known diquaternary ammonium salts are used in hair cosmetic compositions, in particular in shampoos and conditioning rinses.

Diquaternary ammonium salts have been found which, on account of their properties, can be used as textile finishing agents.

Accordingly, the present invention relates to diquaternary ammonium salts of the formula

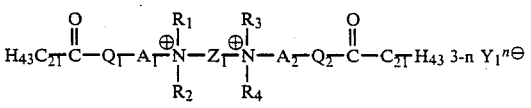

(1)

wherein $A_1$ and $A_2$ are each independently of the other $C_2$–$C_5$alkylene, $Q_1$ and $Q_2$ are each independently of the other —NH— or —O—, $R_1$, $R_2$, $R_3$ and $R_4$ are each independently alkyl, hydroxyalkyl or alkoxyalkyl, each containing 1 to 4 carbon atoms in the alkyl moiety, $Y_1^{n\ominus}$ is the anion of a strong acid, $Z_1$ is $C_3$–$C_{24}$alkylene which is substituted by hydroxy and may be interrupted by oxygen atoms and n is 1 or 2.

The invention further relates to the preparation of the novel diquaternary ammonium salts of this invention by methods known per se and to the use thereof as textile finishing agents.

The alkylene radicals $A_1$ and $A_2$ in formula (1) are straight chain or branched. Possible representatives are 2,2-dimethylpropylene (also referred to as neopentylene), n-butylene (tetramethylene) and, preferably, n-propylene (trimethylene) and ethylene.

Suitable substituents $R_1$ to $R_4$ are straight chain or branched alkyl radicals, e.g. tert-butyl, isobutyl, n-butyl, isopropyl, n-propyl or, preferably, ethyl or methyl. The corresponding hydroxyalkyl radicals, e.g hydroxyethyl, are also suitable. The alkoxyalkyl radicals contain 1 to 4 carbon atoms in both the alkyl moiety and the alkoxy moiety. Thus, alkoxyalkyl radicals contain a total of 2 to 8 carbon atoms, e.g. methoxyethyl and ethoxyethyl. Unsubstituted alkyl radicals of the type indicated above are preferred.

If n is 1, $Y_1^{n\ominus}$ is the monovalent anion of a strong acid, and, if n is 2, $Y_1^{n\ominus}$ is the divalent anion of a strong acid. Depending on the meaning of n, the compound of formula (1) contains either 1 divalent anion or 2 monovalent anions.

The mono- or divalent anion of basically any water-soluble inorganic or organic acid is a suitable anion $Y_1^{n\ominus}$. The anion of an inorganic acid or of an organic sulfonic acid is preferred. Representative examples of such anions are halide, sulfate, methylsulfate or ethylsulfate anions, with halide anions, in particular the chloride anion, being of special interest.

The bridge member $Z_1$ in formula (1) is always substituted by hydroxyl groups, preferably by 1 to 4 hydroxyl groups, and may be interrupted by 2 to 6 oxygen atoms and preferably contains 3 to 24 carbon atoms. Bridge members containing e.g. 3 or 4 carbon atoms are preferably substituted by 1 or 2 hydroxyl groups and are in general not interrupted by oxygen atoms, whereas bridge members containing about 8 to 24 carbon atoms are preferably substituted by 2, 3 or 4 hydroxyl groups and are preferably interrupted by oxygen atoms, most preferably by 2 to 6 oxygen atoms. Bridge members of particular interest are derived from an epihalohydrin, preferably epichlorohydrin, from an aliphatic diepoxide, preferably a diepoxyalkane, e.g. 1,2,3,4-diepoxybutane (also referred to as butadiene dioxide) or 1,4-butanediol diglycidyl ether, or form a diglycidyl ether obtained from an epihalohydrin, preferably epichlorohydrin, and a lower alkylene glycol preferably containing at most 4 carbon atoms, e.g. tetramethylene glycol (1,4-butanediol), dimethyl ethylene glycol (2,3-butanediol), trimethylene glycol (1,3-propanediol) or, preferably, propylene glycol (1,2-propanediol) or, most preferably, ethylene glycol (1,2-ethanediol). Such diglycidyl ethers are monomers or oligomers which contain 2 to 4 —$CH_2$—CH(OH)—$CH_2$—O—($C_2$–$C_4$alkylene)—O— elements or, preferably, 2 to 4 —$CH_2$—CH(OH)—$CH_2$—O—$(CH_2)_2$—O— elements.

The two radicals

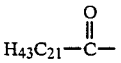

in formula (1) are the radical of preferably technical behenic acid which contains a minor amount of e.g. arachic acid and erucic acid and which is, in particular, the hydrolysis product of unsaturated $C_{22}$ acids from colza oil. Such technical behenic acids have a molecular weight in the range from about 326 to about 354.

The bridge members —$A_1$—$Q_1$— and —$A_2$—$Q_2$— in formula (1) are preferably identical.

Accordingly, preferred diquaternary ammonium salts are of the formula

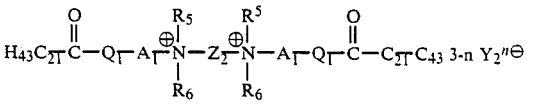

(2)

wherein $R_5$ and $R_6$ are each independently of the other $C_1$–$C_4$alkyl, $Y_2^{n\ominus}$ is the anion of an inorganic acid or of a sulfonic acid, $Z_2$ is $C_3$–$C_{24}$alkylene which is substituted by 1 to 4 hydroxyl groups and which may be interrupted by oxygen atoms and $A_1$, $Q_1$ and n are as defned.

Depending on the number of carbon atoms, the alkylene chain in $Z_2$ may be interrupted by 2 to 6 oxygen atoms.

The $C_1$–$C_4$alkyl substituents in formula (2) are preferably identical. Accordingly, ammonium salts of particular interest are of the formula

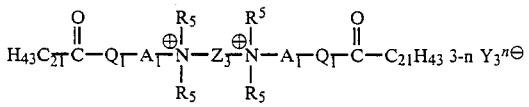

(3)

wherein $Y_3^{n\ominus}$ is a halide, sulfate, methylsulfate or ethylsulfate anion, $Z_3$ is $C_3$–$C_4$alkylene which is substituted by 1 or 2 hydroxyl groups, or $Z_3$ is $C_8$–$C_{24}$alkylene which is substituted by 2 to 4 hydroxyl groups and which is interrupted by 2 to 6 oxygen atoms and $A_1$, $Q_1$, $R_5$ and n are as defined.

Ammoniums salts which are particularly suitable for use as textile finishing agents are those of the formula

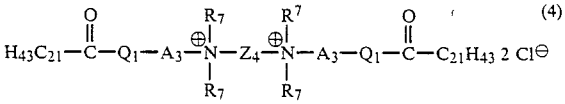

(4)

wherein $A_3$ is ethylene, n-propylene, n-butylene or 2,2-dimethylpropylene, $Q_1$ is —NH— or —O—, $R_7$ is methyl, ethyl or isopropyl and $Z_4$ is $—CH_2—CH(OH)—CH_2—$, $—CH_2—CH(OH)—CH(OH)—CH_2—$ or $—CH_2—CH(OH)—CH_2—O(CH_2)_4—O—CH_2—CH(OH)—CH_2—$.

Particularly interesting diquaternary ammonium salts are those of the formula

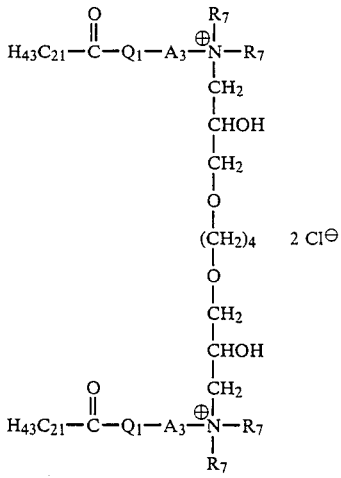

(5)

and, especially, of the formula

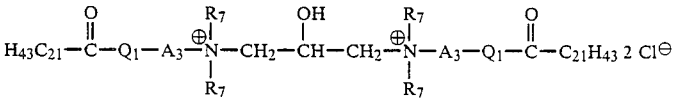

(6)

in which formulae $A_3$, $Q_1$ and $R_7$ are as defined.

The diquaternary ammonium salts of formula (1) are prepared by methods known per se, e.g. by reacting 1 mole of a dialkylaminoalkylbehenic acid amide or ester of the formula

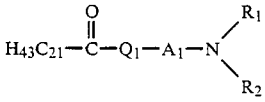

(7)

wherein $A_1$, $Q_1$, $R_1$ and $R_2$ are as defined, and 1 mole of a dialkylaminoalkylbehenic acid amide or ester of the formula

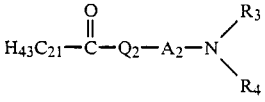

(8)

wherein $A_2$, $Q_2$, $R_3$ and $R_4$ are as defined, with about 1 mole of an epoxy compound of the formula (9) $X_1—Z'—X_2$ wherein $X_1$ is an epoxy group

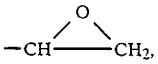

$X_2$ is an epoxy group or a mobile halogen atom and $Z'$ is $C_1$–$C_{20}$alkylene which is unsubstituted or substituted by hydroxy and which may be interrupted by oxygen atoms, or, if $X_2$ is an epoxy group, $Z'$ is also the direct bond, in the presence of a strong acid of the formula

(10) $H_n^{\oplus}Y_1^{n\ominus}$ wherein $Y_1^{n\ominus}$ and n are as defined.

The ammonium salts of formula (2) are prepared by reacting about 2 moles of a dialkylaminobehenic acid amide or ester of the formula

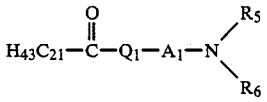

(11)

wherein $A_1$, $Q_1$, $R_5$ and $R_6$ are as defined, with about 1 mole of an epoxy compound of the formula

(12) $X_1—Z''—X_2$ wherein $X_1$ and $X_2$ are as defined and Z'' is $C_1$–$C_{20}$alkylene which is unsubstituted or substituted by 1 or 2 hydroxyl groups and which may be interrupted by 2 to 6 oxygen atoms, or, if $X_2$ is an epoxy group, Z'' is also the direct bond, in the presence of an acid of the formula

(13) $H_n^{\oplus}Y_2^{n\ominus}$ wherein $Y_2$ and n are as defined.

The ammonium salts of formula (3) are prepared by reacting about 2 moles of a dialkylaminoalkylbehenic acid amide or ester of the formula

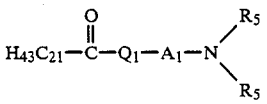

(14)

wherein $A_1$, $Q_1$ and $R_5$ are as defined, with about 1 mole of an epoxy compound of the formula

(15) $X_1—Z'''—X_2$ wherein $X_1$ and $X_2$ are as defined and Z''' is methylene, or, if $X_2$ is an epoxy group, Z''' is the direct bond or $C_4$–$C_{20}$alkylene which is interrupted by 2 to 6 oxygen atoms and which is unsubstituted or substituted by 1 or 2 hydroxyl groups, in the presence of an acid of the formula

(16) $H_n^{\oplus}Y_3^{n\ominus}$ wherein $Y_3$ and n are as defined.

The ammonium salts of formula (4) are prepared by reacting about 2 moles of a dialkylaminoalkylbehenic acid amide or ester of the formula

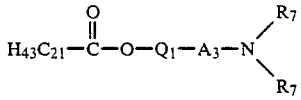

(17)

wherein $A_3$, $Q_1$ and $R_7$ are as defined, with 1 mole of epichlorohydrin, 1,2,3,4-diepoxybutane, 1,4-butanediol diglycidyl ether or a diglycidyl ether which is obtained from ethylene glycol and epichlorohydrin, in the presence of an acid of the formula

(18) $H^{\oplus}Y_4^{\ominus}$ wherein $Y_4^{\ominus}$ is as defined.

The dialkylaminoalkylbehenic acid amides or esters of formulae (7), (8), (11), (14) and (17) are known per se and are prepared by known methods, namely by reacting behenic acid with approximately equimolar amounts of corresponding dialkylaminoalkylamines or dialkylaminoalkanols at a temperature above 100° C., e.g. in the range from 150° to 180° C., with removal of the water of reaction from the reaction mixture.

The reaction of the compounds of formulae (7), (8) and (9) in the presence of an acid of formula (10) is preferably carried out at elevated temperature, e.g. in the range from 50° to 90° C., in general in aqueous medium and, if desired, in the presence of a polar solvent, preferably in the presence of a low molecular amide or ether, e.g. dimethylformamide or diethylene glycol monobutyl ether, or, most preferably, in the presence of a low molecular alkanol, e.g. ethanol or, preferably, butyl glycol or, most preferably, isopropanol. In their application as textile finishing agents, the ammonium salts of this invention are employed as waterproofing agents, anti-crease agents, softeners or agents for improving the sewability, the spinning performance or the soiling behaviour of textiles.

The textile materials to be finished in accordance with this invention may be in any state of processing, i.e. in the form of yarns, staple fibres, continuous threads, nonwovens or, in particular, in the form of wovens or knits. The materials may be dyed or undyed, may or may not have been treated with fluorescent whitening agents or may be in the form of refined garments.

Suitable textile fibres are fully synthetic, regenerated and natural fibres. Mixtures of synthetic and natural fibres are also suitable.

Examples of synthetic fibres are artificial silk, rayon staple, viscose, cellulose diacetate, cellulose triacetate, polyacrylonitrile, acrylonitrile heteropolymers, polyamide, in particular fibres made from poly-2-caprolactam, polyhexylmethylenediamide adipate or poly-ω-aminoundecanoic acid, and polyesters, in particular fibres which are derived from terephthalic acid, e.g. poly(ethylene glycol terephthalate) or poly(1,4-cyclohexylenedimethylene terephthalate). Examples of natural fibres are linen, hemp, ramie, wool and cotton.

Preferred textile materials to be finished are wool, polyacrylonitrile, polyamide polyester or cotton wovens or knits and also woven or knits made from blends of these fibres.

When finishing the textile materials, formulations containing a diquaternary ammonium salts of this invention are applied to said textile materials by customary methods. The formulations may for example be sprayed or slop-padded onto the textile materials. However, the textile materials are preferably padded with the formulations or treated by the exhaust process. Application is effected at room temperature or at elevated temperatures, e.g. in the range from 30° to 100° C., for about 5 to 120 minutes. The textile materials are subsequently dried at room temperature or, preferably, at elevated temperature, i.e. in the range from about 50° to 150° C.

The diquaternary ammonium salts of the invention are conveniently employed in amounts of 0.05 to 5% by weight, preferably 0.1 to 4% by weight, based on the textile material to be finished.

It is a substantial advantage of the diquaternary ammonium salts of the present invention that they produce good finishing effects of the various types described above which can be utilised in a large variety of textile materials. Moreover, the good compatibility of the diquaternary ammonium salts with fluorescent whitening agents, dyes, and auxiliaries and adjuvants customarily employed in the textile industry, e.g. surfactants, is a further advantage.

In the following preparatory procedures and Examples, parts and percentages are by weight.

PROCEDURES FOR THE PREPARATION OF DIALKYLAMINOALKYLBEHENIC ACID AMIDES OR ESTERS

Procedure A

In an inert nitrogen atmosphere, 56.1 parts (0.55 mole) of dimethylaminopropylamine are added over 90 minutes at 160° C. to a melt consisting of 166 parts (0.5 mole) of a technical behenic acid which has a molecular weight of 332. The reaction mixture is subsequently heated to 170° C. and then held, with stirring, for 5 hours at this temperature, with the water of reaction being removed from the reaction mixture. Dimethylamino-n-propylbehenic acid amide with an amine value of 128 and an acid value of 0 is obtained in virtually quantitative yield.

Procedures B to F

The dialkylaminoalkylbehenic acid amides or esters which are listed in Table 1 below and which have the corresponding amine values are obtained in analogous manner by reacting behenic acid with the dialkylaminoalkylamines or dialkylaminoalkanols also listed in Table 1.

TABLE I

| Procedure | Dialkylaminoalkylamine or dialkylaminoalkanol | Dialkylaminoalkyl acid amide or ester | Amine value |
|---|---|---|---|
| B | dimethylaminoethylamine | dimethylaminoethylbehenic acid amide | 131.7 |
| C | dimethylamino-n-propanol | dimethylamino-n-propylbehenic acid ester | 138.6 |
| D | diethylaminoethylamine | diethylaminoethylbehenic acid amide | 134 |
| E | dimethylaminoneopentylamine | dimethylaminoneopentylbehenic acid amide | 122 |
| F | diisopropylaminoethylamine | diisopropylaminoethylbehenic acid amide | 132 |

PREPARATORY EXAMPLES FOR THE DIQUATERNARY AMMONIUM SALTS OF THE PRESENT INVENTION

EXAMPLE 1

A solution of 12.3 g of concentrated hydrochloric acid in 73 g of water and 43 g of isopropanol is added at 60° C. to 106.25 g (0.25 mole) of dimethylaminoethylbehenic acid amide obtained according to Preparatory Procedure B. 11.6 g (0.125 mole) of epichlorohydrin are then added over 15 minutes, and the temperature is subsequently increased to 75° C. With stirring, the reaction solution is held at this temperature for 10 hours, after which time the amine and epoxide values are 0. The reaction solution is then evaporated to dryness, affording 122 g of the diquaternary ammonium compound of the formula

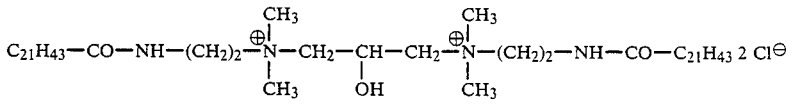

(101)

Melting interval: 70°-98° C.

EXAMPLE 2

A solution of 12.3 g of concentrated hydrochloric acid in 73 g of water and 43 g of isopropanol is added at 60° C. to 101 g (0.25 mole) of dimethylamino-n-propylbehenic acid ester obtained according to Procedure C. 11.6 g (0.125 mole) of epichlorohydrin are then added over 15 minutes, and the temperature is subsequently increased to 75° C. With stirring, the reaction solution is held at this temperature for 10 hours, after which time the amine and epoxide values are 0. The reaction product is then evaporated to dryness, affording 117 g of the diquaternary ammonium compound of the formula

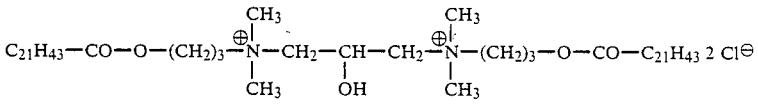

(102)

Melting interval: 76°-84° C.

EXAMPLE 3

A solution of 12.3 g of concentrated hydrochloric acid in 73 g of water and 43 g of isopropanol is added at 60° C. to 104.5 g (0.25 mole) of diethylaminoethylbehenic acid amide obtained according to Procedure D. 11.6 g (0.125 mole) of epichlorohydrin are then added over 15 minutes, and the temperature is subsequently increased to 75° C. With stirring, the reaction solution is held at this temperature for 10 hours, after which time the amine and epoxide values are 0. The reaction solution is then evaporated to dryness, affording 120 g of the diquaternary ammonium compound of the formula

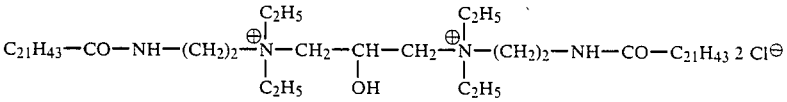

(103)

Melting interval: 57°-60° C.

EXAMPLE 4

109.75 g (0.25 mole) of dimethylamino-n-propylbehenic acid amide obtained according to Procedure A are dissolved, with heating, in 44 g of isopropanol, and then a solution of 12.3 g of concentrated hydrochloric acid in 74 g of water is added. 11.6 g (0.125 mole) of epichlorohydrin are added over 15 minutes at 55° C., and the temperature of the reaction solution is subsequently increased to 75° C. With stirring, the reaction solution is held at this temperature for 3 hours, after which time the amine and epoxide values are 0.

251 g of a 50% reaction solution of the diquaternary ammonium compound of the formula

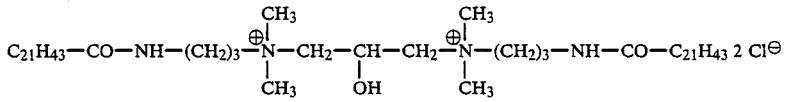

(104)

are obtained, which solution is wax-like at room temperature. Melting interval: 85°–162° C.

EXAMPLE 5

65.6 g (0.15 mole) of dimethylamino-n-propylbehenic acid amide obtained according to Procedure A are melted at 80° C., and 14.8 g of 37% hydrochloric acid in 758.6 g of water are added to the resultant melt. 16.35 g (0.075 mole) of 1,4-butanediol diglycidyl ether with an epoxide value of 4.6 are added over 10 minutes at 60° C. to the reaction mixture. Subsequently, the reaction mixture is heated to 70° C. and, with stirring, held at this temperature for 1 hour, after which time the amine and epoxide values are 0.

855 g of a 10% solution of the diquaternary ammonium salt of the formula

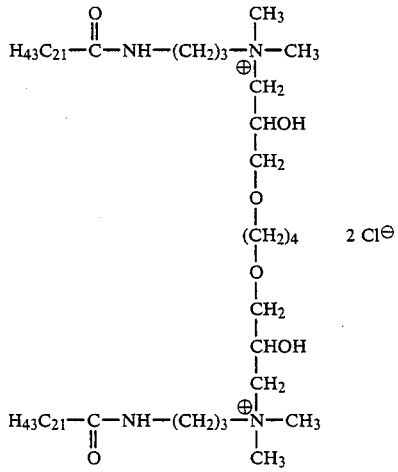

(105)

are obtained.

EXAMPLE 6

65.6 g (0.15 mole) of dimethylamino-n-propylbehenic acid amide obtained according to Procedure A are melted at 80° C., and 5.1 g of sulfuric acid in 1083.6 g of water are added to the resultant melt. 16.35 g (0.075 mole) of 1,4-butanediol diglycidyl ether with an epoxide value of 4.6 are added over 10 minutes at 60° C. The reaction mixture is subsequently heated to 70° C. and, with stirring, held at this temperature for 10 hours, after which time the amine value is 28 and the epoxide value 0.

1170 g of a 7% solution containing mainly the diquaternary ammonium salt of the formula

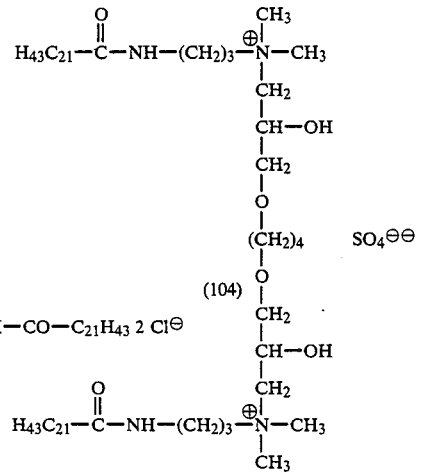

(106)

are obtained.

EXAMPLE 7

45.8 g (0.1 mole) of dimethylaminoeopentylbehenic acid amide obtained according to Procedure E are heated together with 9.9 g of concentrated hydrochloric acid in 500.4 g of water to a temperature of 75° C. Then 10.9 g (0.05 mole) of 1,4-butanediol diglycidyl ether with an epoxide value of 4.6 are added over 15 minutes. The reaction mixture is stirred for 12 hours at 77°–78° C., after which time the amine and epoxide values are 0.

567 g of a 10% solution of the diquaternary ammonium salt of the formula

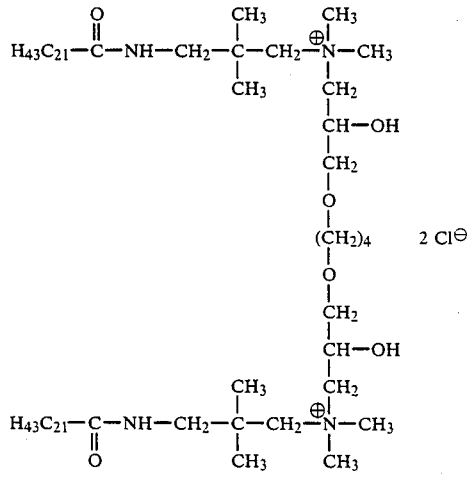

(107)

are obtained.

EXAMPLE 8

42.3 g (0.1 mole) of diisopropylaminoethylbehenic acid amide obtained according to Procedure F are heated together with 9.9 g of concentrated hydrochloric acid in 479.8 g of water to a temperature of 75° C. Then 10.9 g (0.05 mole) of 1,4-butanediol diglycidyl ether with an epoxide value of 4.6 are added over 15 minutes. The reaction mixture is stirred for 12 hours at 75° C., after which time the amine and epoxide values are 0.

542 g of a 10% solution of the diquaternary ammonium salt of the formula

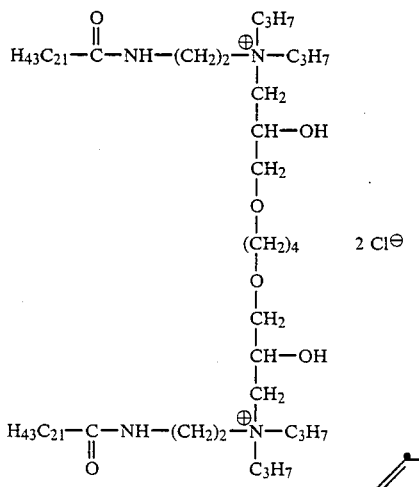

(108)

are obtained.

APPLICATION EXAMPLES

EXAMPLE 9

1 kg of cotton tricot fabric is treated by the exhaust process for 20 minutes at 40° C. (liquor to goods ratio 1:30) with a liquor which contains 4% of the diquaternary ammonium salt of Example 4 and which, after the addition of acetic acid, has a pH value of 5.5. the fabric is subsequently dried without rinsing. In order to test the sewability, a 50 cm seam is sewn onto the fabric with a sewing machine (Overlock Union Special Type 39500) at a rate of 6000 stitches per minute using a polyester long fibre sewing thread. A needle with a size 70 point is used. The number of holes along the seam is assessed in comparison with an untreated cotton tricot fabric. The results are summarized in Table II below:

TABLE II

| Substrate | Number of holes |
|---|---|
| treated tricot fabric | 2 |
| untreated tricot fabric | 19 |

Similar results are also achieved by padding the cotton tricot fabric to 100% pick-up at room temperature (15° to 25° C.) with a liquor containing 40 g/l of the diquaternary ammonium salt of Example 4 and 2 g/l of 80% acetic acid, and subsequently drying the fabric at 90° C.

EXAMPLE 10

The knits tested in Example 9 for sewability are subjected to a soiling test. The soiling in dry state is assessed in accordance with the following test:

| | |
|---|---|
| substrate; size | 9 × 12 cm (several samples) |
| filter dust | 15% (based on the weight of the goods) |
| apparatus | Turbula |
| test duration | 30 minutes |
| | vacuum-cleaned |

The results are summarized in the following Table III

TABLE III

| Substrate | Soiling |
|---|---|
| tricot fabric treated in acc. with Example 6 | none |
| untreated tricot fabric | a little |

EXAMPLE 11

In a winch vat, 100 g of cotton tricot fabric are pretreated at 50° C. in 4000 liters of water containing a commercially available wetting agent.

3 kg of a dye of the formula,

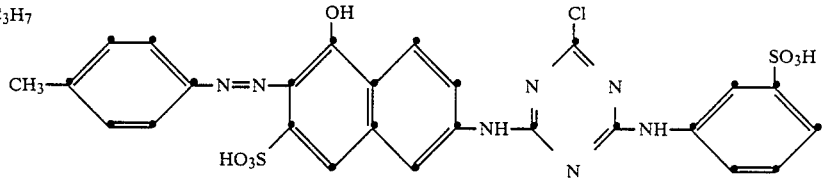

8 kg of sodium m-nitrobenzenesulfonate and, 4 kg of the diquaternary ammonium salt of Example 4 are then added.

After the uniform distribution of these additives, 160 kg of sodium chloride are added by degrees, and the temperature is increased to 80° C.

Subsequently, 12 g of a 30% sodium hydroxide solution are added.

After a further 45 minutes at 80° C., the tricot fabric is rinsed with hot and then with cold water and subsequently washed for 20 minutes at boiling temperature with 4000 liters of a liquor (liquor to goods ratio 1:40) containing 4 kg of an adduct of 1 mole of nonlyphenol and 9 moles of ethylene oxide and 4 kg of the diquaternary ammonium salt of Example 4. The fabric is then again rinsed and dried. Applying the Monsanto scale as a measure of the crease resistance of the treated tricot fabric, grade 4 is obtained. If the tricot is treated as described above but without the addition of the diquaternary ammonium salt in the dye bath or washing liquor, grade 2 according to the Monsanto scale is obtained.

EXAMPLE 12

20 g of bleached cotton terry cloth with a weight per unit area of 330 g/m$^2$ is treated for 5 minutes at 20° C. with 400 ml of water of 5° dH (German hardness degree) containing 0.02 g of the diquaternary ammonium salt of Example 4. The terry cloth is subsequently centrifuged without rinsing and then dried at 70° C. The following textile materials are also subjected to the same treatment:

(a) viscose filament yarn
(b) chlorinated woollen cabled yarn
(c) staple fibre polyamide yarn
(d) high-bulk staple fibre polyacrylonitrile yarn.

The handle of the treated textile materials is assessed in accordance with the following scale:

0=handle unchanged
1=somewhat softer than 0
2=markedly softer than 0
3=much softer than 0
4=very much softer than 0

The results are summarized in Table IV below:

TABLE IV

| Substrate | Untreated | Treated with ammonium salt |
|---|---|---|
| cotton terry cloth | 0 | 2-3 |
| viscose filament yarn | 0 | 4 |
| woollen cabled yarn | 0 | 2 |
| polyamide yarn | 0 | 3-4 |
| polyacrylonitrile yarn | 0 | 3-4 |

Similar results are obtained with the diquaternary ammonium salts of Examples 1, 2, 3 or 5 to 8.

Example 13

A washing machine with a capacity of about 4 kg is filled with the following material:

| | |
|---|---|
| 300 g of | bleached cotton terry cloth (weight per unit area: 330 g/m$^2$) |
| 300 g of | bleached mercerised cotton tricot fabric (weight per unit area: 150 g/m$^2$) |
| 300 g of | viscose taffeta (weight per unit area: 105 g/m$^2$) |
| 300 g of | polyamide 6,6 helanca tricot fabric, type HE (weight per unit area: 260 g/m$^2$) |
| 300 g of | polyester crimplene tricot fabric (weight per unit area: 225 g/m$^2$) |
| 300 g of | polyacrylonitrile tricot fabric, type 42 (weight per unit area: 330 g/m$^2$) |
| 1800 g | |

The contents of the machine are washed at 40° C. with 80 g of a commercially available detergent. The hardness of the water is about 10° dH. For the final rinse (=20 l) a solution of 2 g of the diquaternary ammonium salt of Example 4 in 200 ml of water is added, and the textile material is treated with said solution for 5 minutes. The textile material is subsequently centrifuged and dried at 70° C. The handle of the textile materials thus treated is assessed in accordance with the scale indicated in Example 12. The results are summarized in Table V below:

TABLE V

| Substrate | Treated without ammonium salt | Treated with ammonium salt |
|---|---|---|
| cotton terry cloth | 0 | 3 |
| cotton tricot fabric | 0 | 2-3 |
| viscose taffeta | 0 | 2-3 |
| polyamide tricot fabric | 0 | 2 |
| polyester tricot fabric | 0 | 2 |
| polyacrylonitrile tricot fabric | 0 | 4 |

What is claimed is:

1. A diquaternary ammonium salt of the formula

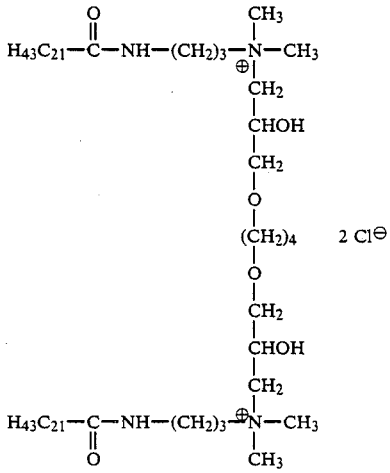

2. In a method for the finishing of textile materials which comprises applying a textile finishing agent to the textile material, the improvement wherein a diquaternary ammonium salt according to claim 1 is applied to the textile material as the textile finishing agent.

3. A method according to claim 2 wherein the textile finishing agent is applied as a waterproofing agent, an anti-crease agent, a softener, an agent for improving sewability, an agent to improve spinning performance, or an agent to improve the soiling behavior of the textile material.

* * * * *